US007040284B2

(12) United States Patent
Demura et al.

(10) Patent No.: US 7,040,284 B2
(45) Date of Patent: May 9, 2006

(54) INTERNAL COMBUSTION ENGINE CONTROLLER

(75) Inventors: Takayuki Demura, Mishima (JP); Koichi Ueda, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/067,644

(22) Filed: Feb. 28, 2005

(65) Prior Publication Data

US 2005/0211222 A1 Sep. 29, 2005

(30) Foreign Application Priority Data

Mar. 29, 2004 (JP) ..... 2004-095687

(51) Int. Cl.
*F02D 9/08* (2006.01)

(52) U.S. Cl. ..... 123/339.11; 123/406.23

(58) Field of Classification Search ..... 123/339.11, 123/406.23, 406.35, 295, 436, 406.43, 406.54
See application file for complete search history.

(56) References Cited

U.S. PATENT DOCUMENTS 4,736,726 A * 4/1988 Matsuno et al. ..... 123/501
5,495,835 A * 3/1996 Ueda ..... 123/339.11
5,542,389 A * 8/1996 Miyamoto et al. ..... 123/339.1
5,979,404 A * 11/1999 Minowa et al. ..... 123/399
6,009,852 A * 1/2000 Akabori et al. ..... 123/339.19
6,497,212 B1 * 12/2002 Matsumoto et al. ..... 123/295
6,513,489 B1 * 2/2003 Osanai ..... 123/339.11

FOREIGN PATENT DOCUMENTS

JP B2 2505304 4/1996
JP A 09-126035 5/1997

* cited by examiner

*Primary Examiner*—Mahmoud Gimie
(74) *Attorney, Agent, or Firm*—Oliff & Berridge, PLC

(57) ABSTRACT

A torque correspondence value (e.g., estimated indicated torque) is determined. The degree of torque correspondence value variation in a plurality of previous cycles is digitized as a variation index value (e.g., locus length). If the variation index value is smaller than a predetermined first judgment value, the intake air amount of an internal combustion engine is corrected. If the variation index value is not smaller than the first judgment value, the ignition timing of the internal combustion engine is corrected. If the variation index value is not smaller than a second judgment value, which is greater than the first judgment value, the ignition timing and fuel injection amount of the internal combustion engine are both corrected.

10 Claims, 6 Drawing Sheets

Detection period
High
Estimated indicated torque

High
Locus length of estimated indicated torque
First judgment value

High
Target rotation speed
Rotation speed

Advanced
Ignition timing

High
Throttle opening

High
Fuel injection amount
Cycles

Detection period
High
Estimated indicated torque

High
Locus length of estimated indicated torque
Second judgment value
First judgment value High
Target rotation speed
Rotation speed
Advanced Ignition timing
High Throttle opening
High Fuel injection amount
Cycles

INTERNAL COMBUSTION ENGINE CONTROLLER

BACKGROUND OF THE INVENTION

1. Field of the Invention

The present invention relates to an internal combustion engine control technology, and more particularly to an internal combustion engine control technology that is suitable for controlling an idling speed during a cold start.

2. Background Art

During a cold start, the rotation speed of an internal combustion engine is likely to differ from a target rotation speed. Therefore, various technologies were proposed for controlling an idling speed during a cold start. The technology disclosed, for instance, by Japanese Patent No. 2505304 (hereinafter referred to as "Patent Document 1") inhibits the rotation variation of an internal combustion engine during a cold start. The technology described in Patent Document 1 detects the rotation variation of each cylinder during idling. If an upper limit value is exceeded by the rotation variation of a certain cylinder, this technology decreases an injection amount for the cylinder and increases the injection amount for the other cylinders. If, on the other hand, a lower limit value is exceeded by the rotation variation of a certain cylinder, this technology increases the injection amount for the cylinder and decreases the injection amount for the other cylinders.

The difference between the actual rotation speed and target rotation speed of an internal combustion engine during a cold start is attributable to various causes. One cause is a friction change with time, a temporary increase in the air-conditioner load or other electrical load, or a manufacturing error such as the flow rate variation of a throttle system. Another cause is the use of heavy fuel. If the former causes exist, the intake air amount deviates from its target value no matter whether the combustion state prevailing within the internal combustion engine is good. As a result, the actual rotation speed deviates from the target rotation speed. If, on the other hand, the latter cause exists, the air-fuel ratio is likely to become lean because the heavy fuel is more unlikely to evaporate than the regular fuel. As a result, the rotation speed varies due to combustion state degradation such as irregular combustion or engine flame-out, causing the actual rotation speed to differ from the target rotation speed. To assure stable idle running, it is necessary to control the internal combustion engine in such a manner as to eliminate the difference between the actual rotation speed and target rotation speed. It is believed that the optimum control method varies depending on whether the combustion state is good or not.

However, the conventional technology is not concerned with the cause of the difference between the actual rotation speed and the target rotation speed for idling speed control. The technology disclosed, for instance, by Patent Document 1 corrects the fuel injection amount in accordance with the degree of rotation variation and without regard to the cause of rotation variation. However, if rotation variation arises out of the use of heavy fuel, the technology adds a considerable amount of fuel, thereby incurring exhaust emission deterioration. To efficiently eliminate the difference between the actual rotation speed and target rotation speed while avoiding such exhaust emission deterioration, it is necessary to employ an optimum control method in accordance with the cause of rotation variation.

SUMMARY OF THE INVENTION

The present invention has been made to solve the above problems. It is an object of the present invention to provide an internal combustion engine controller that is capable of efficiently eliminating the difference between the actual rotation speed and target rotation speed while applying various internal combustion engine control methods in accordance with the cause of the difference between the actual rotation speed and target rotation speed.

In accordance with one aspect of the present invention, the controller comprises a unit for judging whether the actual rotation speed of an internal combustion engine differs from a target rotation speed; a unit for calculating a torque correspondence value corresponding to torque generated by the internal combustion engine from operation data about the internal combustion engine; a unit for calculating a variation index value by digitizing the degree of variation of the torque correspondence value in a plurality of previous cycles; a unit for adjusting the intake air amount of the internal combustion engine; a unit for adjusting the ignition timing of the internal combustion engine; and a unit for controlling the internal combustion engine to eliminate the difference between said actual rotation speed and said target rotation speed. The control unit causes the intake air amount adjustment unit to correct the intake air amount of the internal combustion engine when the index value calculated by the variation index value calculation unit is smaller than a predetermined first judgment value or causes the ignition timing adjustment unit to correct the ignition timing of the internal combustion engine when the index value is not smaller than the first judgment value.

Other objects and further features of the present invention will be apparent from the following detailed description when read in conjunction with the accompanying drawings.

DESCRIPTION OF THE PREFERRED EMBODIMENT

Embodiments of the present invention will now be described with reference to FIGS. 1 through 7.

Figure 1:
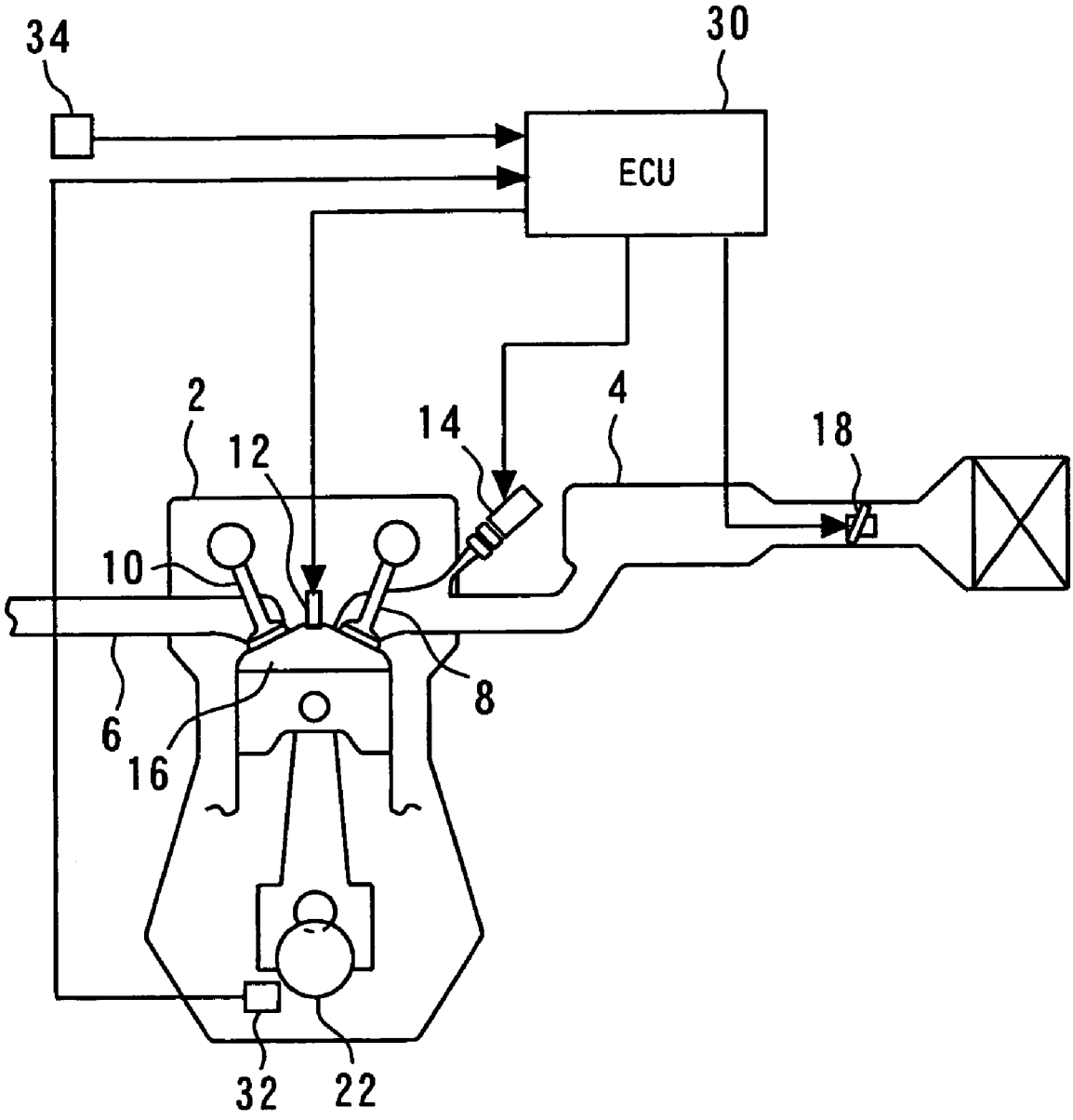
FIG. 1 schematically shows the configuration of an engine system to which a controller according to one embodiment of the present invention is applied.

FIG. 1 schematically shows the configuration of an engine system to which a controller according to one embodiment of the present invention is applied. An internal combustion engine 2 according to the present embodiment is a spark ignition type, 4-stroke engine. It has a plurality of cylinders (not shown). A combustion chamber 16 of each cylinder is connected to an intake path 4 and an exhaust path 6. The joint between the combustion chamber 16 and intake path 4 is provided with an intake valve 8, which controls the communication between the combustion chamber 16 and intake path 4. The joint between the combustion chamber 16 and exhaust path 6 is provided with an exhaust valve 10, which controls the communication between the combustion chamber 16 and exhaust path 6. An ignition plug 12 is mounted on the top of the combustion chamber 16. An electronic control type throttle valve 18 is provided in the intake path 4 in order to adjust the amount of fresh air flow to the combustion chamber 16. The end of the intake path 4 is branched for the purpose of supplying air to the combustion chamber 16 of each cylinder. Each branch path is provided with a fuel injection valve 14, which supplies fuel to the combustion chamber 16.

The internal combustion engine 2 has an ECU (Electronic Control Unit) 30, which serves as a controller for the internal combustion engine 2. In accordance with internal combustion engine operation data that is acquired by a plurality of sensors, the ECU 30 exercises overall control over various devices, which relate to the operating status of the internal combustion engine 2. An input end of the ECU 30 is connected to a crank angle sensor 32 and a water temperature sensor 34. An output end of the ECU 30 is connected to the ignition plug 12, fuel injection valve 14, and throttle valve 18. The crank angle sensor 32 is positioned near a crankshaft 22 of the internal combustion engine 2 to output a signal to the ECU 30 at a predefined crank angle position. The water temperature sensor 34 is mounted on a water jacket (not shown) to output a signal in accordance with the temperature of cooling water for the internal combustion engine 2. The ECU 30 receives the internal combustion engine operation data from the crank angle sensor 32 and water temperature sensor 34 and supplies drive signals to the ignition plug 12, fuel injection valve 14, and throttle valve 18. The ECU 30 is connected not only to the above sensors 32, 34 and devices 12, 14, 18 but also to the other sensors and devices that are not described herein.

As a function of the ECU 30 according to the present embodiment, torque correction control is exercised during a cold fast idling period. FIGS. 2 and 3 illustrate torque correction control that the ECU 30 exercises during a cold fast idling period. When the actual rotation speed of the internal combustion engine 2, which is calculated from a crank angle signal, differs from a target rotation speed, the ECU 30 exercises torque correction control, which will be described below. The torque correction control exercised by the ECU 30 can be divided into two types: control exercised when the torque variation of the internal combustion engine 2 is small and control exercised when the torque variation of the internal combustion engine 2 is great. The ECU 30 selectively exercises appropriate control after judging whether the torque variation is great or small.

The ECU 30 calculates a torque correspondence value, which corresponds to torque generated by each cylinder of the internal combustion engine 2, from internal combustion engine operation data, checks for calculated value variation, and judges whether the torque variation is great or small. The torque correspondence value can be calculated, for instance, from a crank angle signal that is supplied from the crank angle sensor 32. This calculation is performed in accordance with the motion equation as described below.

Equations (1) and (2) below are used to calculate torque from the crank angle signal that is supplied from the crank angle sensor 32:

$$Ti = J\times(d\omega/dt) + Tf + Tl \quad (1)$$

$$Ti = Tgas + Tinertia \quad (2)$$

In Equations (1) and (2) above, the symbol Ti represents indicated torque that is generated on the crankshaft 22 due to internal combustion engine combustion. The right-hand side of Equation (2) shows torque that generates the indicated torque Ti. The right-hand side of Equation (1) shows torque that consumes the indicated torque Ti.

On the right-hand side of Equation (1), the symbol J represents the moment of inertia of a drive member that is driven by air-fuel mixture combustion; dω/dt represents the angular acceleration of the crankshaft 22; Tf represents drive section friction torque; and Tl represents load torque that is received from the road surface during a drive. J×(dω/dt) is dynamic loss torque (=Tac), which results from angular acceleration of the crankshaft 22. The friction torque Tf is torque of mechanical friction between mating parts such as friction between a piston and a cylinder inner wall. This torque includes torque that results from mechanical friction between auxiliary machines. The load torque Ti is torque that is generated due to disturbance, for instance, from the road surface on which the vehicle moves. Since the gear is in neutral during cold fast idling, the subsequent explanation assumes that Ti=0.

On the right-hand side of Equation (2), the symbol Tgas represents torque that is generated due to cylinder internal gas pressure, and the symbol Tinertia represents inertia torque that is generated due to reciprocative inertia mass such as that of a piston. Torque Tgas, which is based on the cylinder internal gas pressure, is generated due to air-fuel mixture combustion in a cylinder. For accurate estimation of the combustion state, it is necessary to determine torque Tgas, which is based on the cylinder internal gas pressure.

As shown in Equation (1), the indicated torque Ti can be determined by calculating the sum of the dynamic loss torque J×(dω/dt), which arises out of angular acceleration, friction torque Tf, and load torque Tl. However, the indicated torque Ti does not coincide with torque Tgas, which is based on the cylinder internal gas pressure, as shown in Equation (2). Therefore, the combustion state cannot be accurately estimated from the indicated torque Ti.

Figure 5:
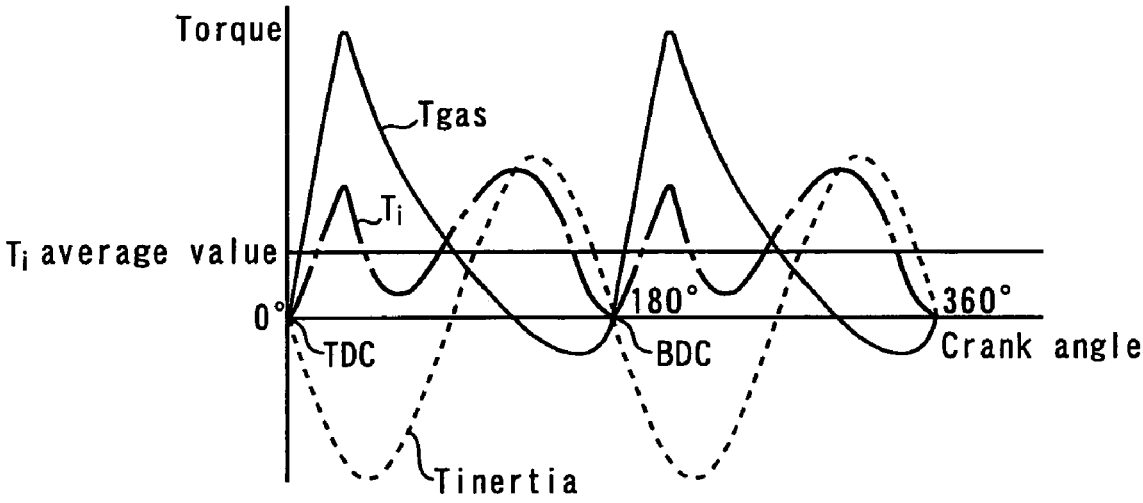
FIG. 5 is a characteristic diagram that illustrates the relationship among indicated torque, torque based on cylinder internal pressure, inertia torque based on reciprocative inertia mass, and crank angle.

FIG. 5 presents characteristic curves that illustrate the relationship between various torques in Equation (2) and crank angle. In FIG. 5, the vertical axis indicates the magnitude of each torque, whereas the horizontal axis indicates the crank angle. The one-dot chain line in FIG. 5 represents the indicated torque Ti; solid line represents torque Tgas, which is based on the cylinder internal gas pressure; broken line represents inertia torque Tinertia, which is based on the reciprocative inertia mass. FIG. 5 illustrates characteristic curves that prevail when a four-cylinder internal combustion engine is used. The symbols TDC and BDC in FIG. 5 are used to indicate a crank angle (0° or 180°) that prevails when a piston of one of the four cylinders is at the top dead center (TDC) or bottom dead center (BDC). When an internal combustion engine 10 has four cylinders, an explosion process is performed for one cylinder each time the crankshaft 22 rotates 180°. The torque characteristic between the TDC and BDC, which are shown in FIG. 5, repeatedly appears each time an explosion occurs.

As indicated by the solid line in FIG. 5, torque Tgas, which is based on the cylinder internal gas pressure, rapidly increases and decreases between the TDC and BDC. Torque Tgas rapidly increases because the air-fuel mixture explodes in a combustion chamber during an explosion stroke. After explosion, torque Tgas decreases to a negative value through the influence of the other cylinders, which are in a compression stroke or exhaust stroke. When the crank angle later reaches the BDC, the cylinder's cubic capacity change becomes zero so that the value Tgas is 0.

Meanwhile, the inertia torque Tinertia, which is based on the reciprocative inertia mass, is generated due to the inertia mass of a piston or other reciprocating members without regard to torque Tgas, which is based on the cylinder internal gas pressure. The reciprocating members repeatedly accelerate and decelerate. Therefore, while the crank rotates, the inertia torque Tinertia is always generated even if the angular velocity is constant. As indicated by the broken line in FIG. 5, the reciprocating members are stopped when the crank angle is at the TDC so that Tinertia=0. When the crank angle changes from the TDC to the BDC, the reciprocating members, which have been stopped, begin to move. In this instance, the inertia torque Tinertia increases in the negative direction due to the inertia of these members. Since the reciprocating member moves at a predetermined speed when the crank angle is close to 90°, the crankshaft 22 rotates due to the inertia of these members. Therefore, the inertia torque Tinertia changes from a negative value to a positive value between the TDC and BDC. When the crank angle later reaches the BDC, the reciprocating members come to a stop so that Tinertia=0.

As indicated by Equation (2), the indicated torque Ti is the sum of torque Tgas, which is based on the cylinder internal gas pressure, and the inertia torque Tinertia, which is based on the reciprocative inertia mass. Therefore, the indicated torque Ti exhibits a complex behavior as indicated by the one-dot chain line in FIG. 5. More specifically, the indicated torque Ti increases between the TDC and BDC due to Tgas increase caused by air-fuel mixture explosion, then decreases temporarily, and increases again due to the inertia torque Tinertia.

Within a 180° crank angle region between the TDC and BDC, the average value of the inertia torque Tinertia, which is based on the reciprocative inertia mass, is 0. The reason is that the movement of a member having the reciprocative inertia mass at crank angles of 0° to 90° is the reversal of the movement of the member at crank angles of 90° to 180°. Therefore, when the torques of Equations (1) and (2) are calculated as an average value between the TDC and BDC, the calculation can be performed so that the inertia torque Tinertia, which is based on the reciprocative inertia mass, is equal to zero. This ensures that the influence of the inertia torque Tinertia, which is based on the reciprocative inertia mass, upon the indicated torque Ti can be eliminated. Consequently, the precise combustion state can be estimated with ease.

When the average value of each torque between the TDC and BDC is determined, the average value of Tinertia is 0. It is then obvious from Equation (2) that the average value of the indicated torque Ti is equal to the average value of torque Tgas, which is based on the cylinder internal gas pressure. It is therefore possible to accurately estimate the combustion state in accordance with the indicated torque Ti.

When the average angular acceleration of the crankshaft 22 between the TDC and BDC is determined, the average value of Tinertia between the TDC and BDC is 0. Therefore, it is possible to determine the angular acceleration with the influence of the reciprocative inertia mass upon the angular acceleration eliminated. Consequently, the angular acceleration resulting from only the combustion state can be calculated. As a result, it is possible to accurately estimate the combustion state in accordance with the angular acceleration.

Figure 6:
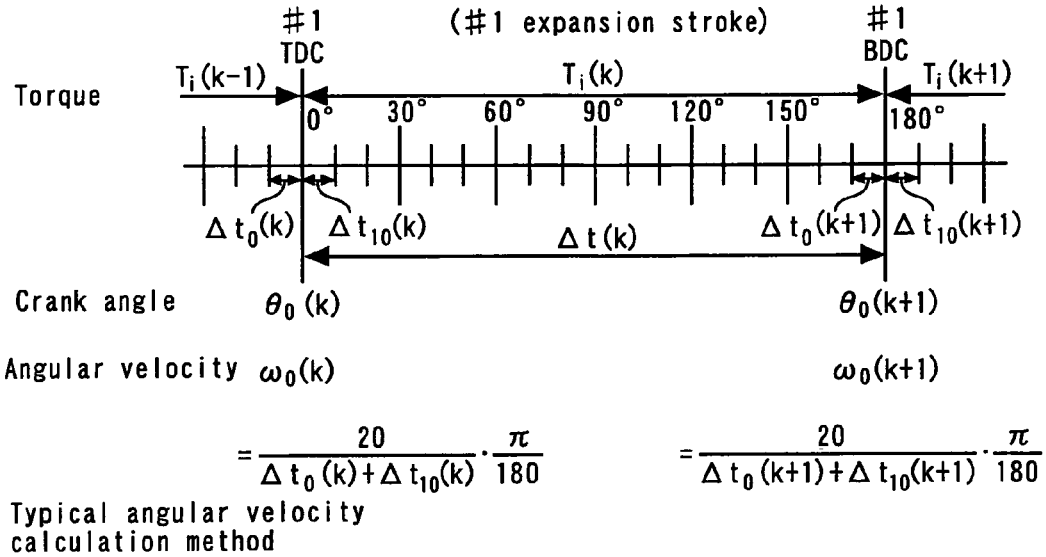
FIG. 6 is a schematic diagram illustrating a crank angle signal and torque calculation timing.

The method for calculating the torques on the right-hand side of Equation (1) will now be described. First of all, the dynamic loss torque ($Tac=J\times(d\omega/dt)$, which arises out of angular acceleration, will be described. FIG. 6 is a schematic diagram illustrating the method for determining the angular acceleration of the crankshaft 22. This figure describes a crank angle signal and torque calculation timing. In the present embodiment, the crank angle sensor 32 supplies a crank angle signal each time the crankshaft 22 rotates 10°, as shown in FIG. 6.

The ECU 30 calculates the loss torque Tac, which arises out of angular acceleration, as an average value between the TDC and BDC. Therefore, the apparatus according to the present embodiment determines angular velocities $\omega_0(k)$ and $\omega_0(k+1)$ respectively at two crank angle positions (TDC and BDC) and simultaneously determines the time $\Delta t(k)$ during which the crankshaft 22 rotates from the TDC to the BDC.

When angular velocity $\omega_0(k)$ is to be determined, the crank angle sensor 32 detects time $\Delta t_0(k)$ and time $\Delta t_{10}(k)$ during which the crank angle rotates ±10° from the TDC as shown, for instance, in FIG. 6. The crankshaft 22 rotates 20° during the time $\Delta t_0(k)+\Delta t_{10}(k)$. Therefore, $\omega_0(k)$ [rad/s] can be determined by calculating $\omega_0(k)=(20/(\Delta t_0(k)+\Delta t_{10}(k))\times(\pi/180)$. Similarly, when $\omega_0(k+1)$ is to be calculated, time $\Delta t_0(k+1)$ and time $\Delta t_{10}(k+1)$ during which the crank angle rotates ±10° from the BDC are detected. Then, $\omega_0(k+1)$ [rad/s] can be determined by calculating $\omega_0(k+1)=(20/(\Delta t_0(k+1)+\Delta t_{10}(k+1))\times(\pi/180)$. After angular velocities $\omega_0(k)$ and $\omega_0(k+1)$ are determined, $(\omega_0(k+1)-\omega_0(k))/\Delta t(k)$ is calculated to determine the average angular acceleration during a period during which the crankshaft 22 rotates from the TDC to the BDC.

After the average angular acceleration is determined, the average angular acceleration is multiplied by the moment of inertia J in accordance with the right-hand side of Equation (1). The average value of the dynamic loss torque $J\times(d\omega)/dt)$ during a period during which the crankshaft 22 rotates from the TDC to the BDC can then be calculated. The moment of inertia J of the drive section should be predetermined from the inertia mass of drive parts.

Figure 7:
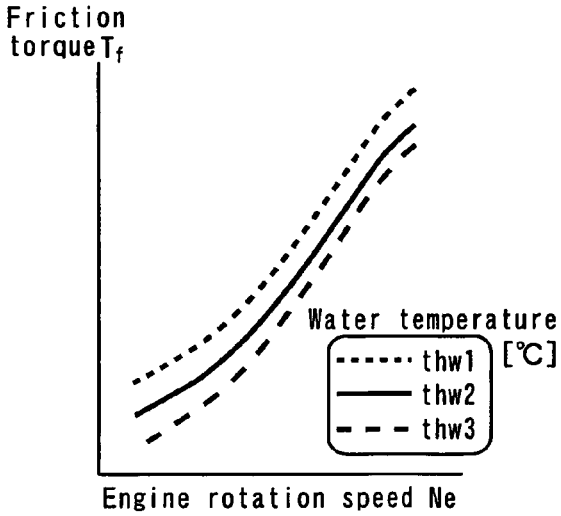
FIG. 7 is a schematic diagram illustrating a map that shows the relationship among friction torque, rotation speed, and cooling water temperature.

The method for calculating the friction torque Tf will now be described. FIG. 7 is a map illustrating the relationship among the friction torque Tf, internal combustion engine rotation speed Ne, and cooling water temperature thw. In FIG. 7, the illustrated friction torque Tf, engine rotation speed Ne, and cooling water temperature thw represent average values that are obtained when the crankshaft 22 rotates from the TDC to the BDC. As regards the cooling water temperature, thw1 is higher than thw2 and thw2 is higher than thw3. As indicated in FIG. 7, the friction torque Tf increases with an increase in the engine rotation speed (Ne) and increases with a decrease in the cooling water temperature thw. The map shown in FIG. 7 is prepared beforehand by varying the engine rotation speed Ne and cooling water temperature thw as parameters, measuring the friction torque Tf that is generated when the crankshaft 22 rotates from the TDC to the BDC, and calculating the average of the measurements taken. When the combustion state is to be estimated, the average value of the friction torque Tf is determined by applying the average cooling water temperature and average engine rotation speed during a period between the TDC and BDC to the map shown in FIG. 7. The cooling water temperature is detected by the water temperature sensor 34, whereas the engine rotation speed is detected by the crank angle sensor 32.

The behavior of the friction torque Tf, which is induced by crank angle variation, is very complicated. Further, the friction torque Tf greatly varies. However, the behavior of the friction torque Tf mainly depends on the piston speed. Therefore, the average value of the friction torque Tf remains almost unchanged in all blocks in which the average value of the inertia torque Tinertia, which is based on the reciprocative inertia mass, is 0. Consequently, the friction torque Tf, which exhibits complicated instantaneous behavior, can be accurately determined by determining the average value of the friction torque Tf in each block (TDC→BDC) in which the average value of the inertia torque Tinertia, which is based on the reciprocative inertia mass, is 0. Further, when the friction torque Tf is used as the average value for each block, the map shown in FIG. 7 can be accurately prepared.

As described earlier, the friction torque Tf contains torque that arises out of auxiliary machine friction. The value of the torque arising out of auxiliary machine friction varies depending on whether the auxiliary machines operate. For example, the rotation of the internal combustion engine is transmitted via a belt or the like to an air-conditioner compressor, which is an auxiliary machine. Therefore, friction-induced torque is generated even when the air conditioner is not actually operating.

If, on the other hand, an auxiliary machine is operated, that is, the air conditioner switch is turned ON, greater torque is consumed by the compressor than when the air conditioner is not operating. Therefore, an increased torque is generated by auxiliary machine friction so that the value of the friction torque Tf increases. To accurately determine the friction torque Tf, therefore, it is preferred that the value of the friction torque Tf determined from the map shown in FIG. 7 be corrected when the auxiliary machine operation status is detected with the auxiliary machine switches turned ON.

At the time of extremely cold startup, it is preferred that the friction torque Tf be corrected while considering the difference between the temperature of a section in which friction torque Tf is generated and the cooling water temperature. In this instance, it is preferred that the correction be made in consideration of the engine startup time after cold startup, the amount of fuel flow into cylinder, and the like.

In the present embodiment, the above indicated torque (hereinafter referred to as the estimated indicated torque) Ti is used as a torque correspondence value corresponding to torque generated by a cylinder. The ECU 30 calculates the estimated indicated torque of each cylinder by the above calculation method. This calculation is performed on a plurality of cycles after internal combustion engine startup to determine the degree of calculated value variation. The degree of estimated indicated torque variation can be judged from the locus length of the estimated indicated torque. The locus length is obtained by calculating the amount of estimated indicated torque variation in each cycle and adding up the calculated absolute values. The greater the degree of estimated indicated torque variation becomes per cycle, the greater the locus length is. Therefore, when the locus length derived from predetermined cycles after internal combustion engine startup is compared against a predefined judgment value, the result of comparison can be used to determine the degree of internal combustion engine torque variation.

Figures 2A, 2B, 2C, 2D, 2E, 2F:
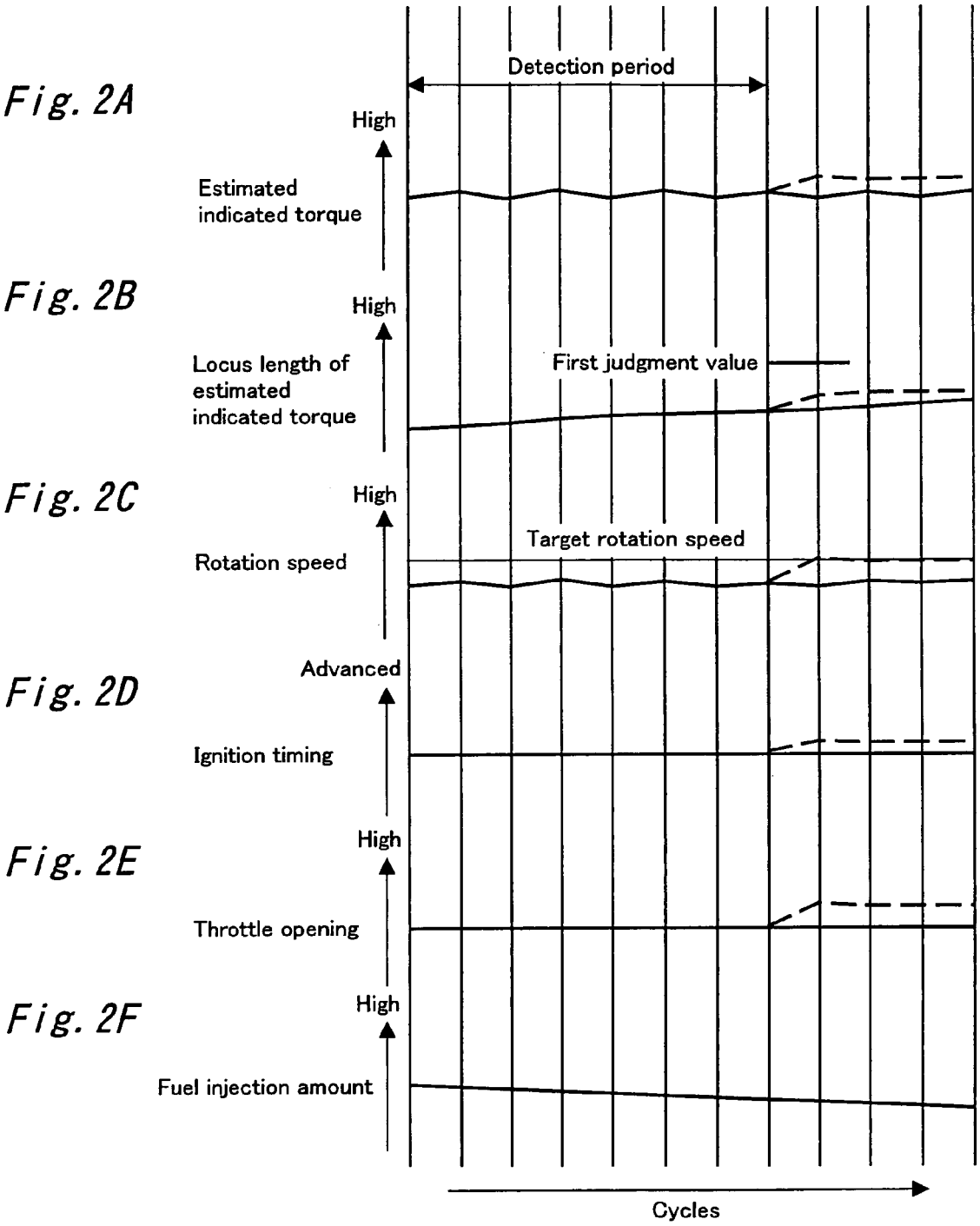
FIGS. 2A through 2F illustrate torque correction control that is exercised by one embodiment according to the present invention when torque variation is small.
Figures 3A, 3B, 3C, 3D, 3E, 3F:
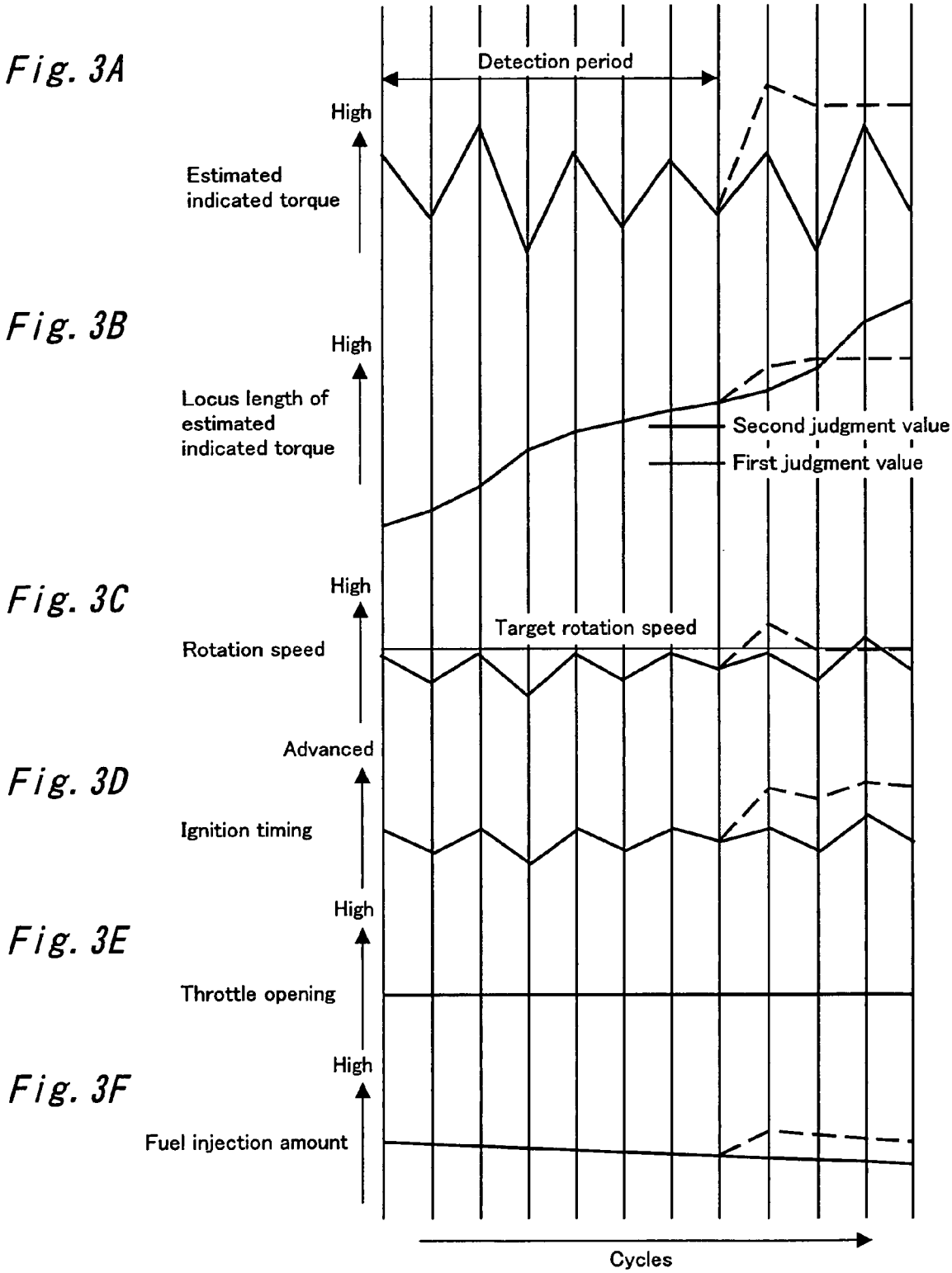
FIGS. 3A through 3F illustrate torque correction control that is exercised by one embodiment according to the present invention when torque variation is great.

FIGS. 2A through 2F illustrate torque correction control that the ECU 30 exercises when the torque variation of the internal combustion engine 2 is small. FIGS. 3A through 3F illustrate torque correction control that the ECU 30 exercises when the torque variation is great. As indicated an estimated indicated torque change per cycle, the estimated indicated torque shown in FIG. 2A varies slightly, whereas the estimated indicated torque shown in FIG. 3A varies greatly. The degree of estimated indicated torque variation appears in the form of locus length, which is represented by an index value for estimated indicated torque variation. When the degree of variation is small, the locus length is small as indicated in FIG. 2B. When the degree of variation is great, on the other hand, the locus length is great as indicated in FIG. 3B. The present invention assumes that the employed internal combustion engine 2 is an inline four-cylinder engine. The ECU 30 performs a detection sequence during eight cycles (two cycles for each cylinder) subsequent to internal combustion engine startup, and compares the locus length reached in the eighth cycle against a predetermined first judgment value to judge whether a good or bad combustion state prevails. If the result of comparison indicates that the locus length is smaller than the first judgment value, torque correction control is exercised as indicated in FIGS. 2A through 2F. If, on the other hand, the result of comparison indicates that the locus length is not smaller than the first judgment value, torque correction control is exercised as indicated in FIGS. 3A through 3F. As regards the first judgment value, the relationship between the internal combustion engine rotation state and locus length should be determined through experiments or the like. The first judgment value should be set in accordance with the determined relationship.

Control exercised when the torque variation of the internal combustion engine 2 is small will now be described with reference to FIGS. 2A through 2F. FIGS. 2A through 2F show how the estimated indicated torque, estimated indicated torque locus length, rotation speed, ignition timing, throttle opening, and fuel injection amount change in each cycle. A detection sequence is performed for the first eight cycles after startup to judge the degree of estimated indicated torque variation. While the detection sequence is performed, normal cold fast idling control is exercised. For cold fast idling control, ignition timing setup is performed by referencing a map in which the internal combustion engine rotation speed and load are used as parameters (or a map in which only the rotation speed is used as a parameter). The load on the internal combustion engine 2 is calculated from the rotation speed and throttle opening. The throttle opening is set for a predefined idle opening. The fuel injection amount is set to a predefined startup fuel amount. The startup fuel amount is rich relative to an intake air amount that is determined according to the idle opening. After startup, the fuel injection amount gradually decreases. Torque correction control according to the present invention begins in the first cycle after the detection sequence.

If the degrees of torque variation and rotation speed variation are both small as indicated in FIGS. 2A and 2C, it can be concluded that the combustion state of the internal combustion engine 2 is good. In this instance, the actual rotation speed of the internal combustion engine 2 may be below a target rotation speed, as indicated in FIG. 2C, due to a friction change with time, a temporary increase in the air-conditioner load or other electrical load, or a manufacturing error such as a throttle system flow rate variation. The main parameters to be used for adjusting the rotation speed of the internal combustion engine 2 are the ignition timing, intake air amount, and fuel supply amount. However, the ignition timing affects the combustion state, and the fuel injection amount affects the exhaust emission. Under these circumstances, the present embodiment corrects the intake air amount for the purpose of adjusting the rotation speed of the internal combustion engine 2 while maintaining a good combustion state and avoiding exhaust emission deterioration.

The ECU 30 raises the rotation speed by increasing the throttle opening above its idle opening level in order to increase the intake air amount for correction purposes. The ECU 30 determines a throttle opening correction amount in accordance with a deviation between the actual rotation speed and target rotation speed and the water temperature of the internal combustion engine 2. More specifically, the ECU 30 references a map (not shown) to set a basic correction amount for the throttle opening in accordance with a deviation between the actual rotation speed and target rotation speed, multiplies the basic correction amount by a correction coefficient corresponding to a water temperature detected by the water temperature sensor 34, and sets the obtained value as the throttle opening correction amount. As regards the ignition timing and fuel supply amount, regular control is continuously exercised. Solid lines in FIGS. 2A through 2F indicate changes that occur when torque correction control according to the present invention is not exercised. Broken lines indicate changes that occur when torque correction control according to the present invention is exercised. As indicated in FIG. 2D, the ignition timing advances after the end of the detection period because the rotation speed is increased by a throttle opening correction. As described above, the ignition timing is set in accordance with the mapped rotation speed data. Therefore, the ignition timing advances automatically in accordance with an increase in the rotation speed.

When torque correction control is exercised as described above, the intake air amount is increased for correction purposes so that the internal combustion engine 2 generates an increased torque and raises the rotation speed. This makes it possible to maintain a good combustion state and eliminate the difference between the actual rotation speed and target rotation speed without incurring exhaust emission deterioration, thereby providing a stable idling operation.

If a difference still exists between the actual rotation speed and target rotation speed after the above control is exercised to correct the throttle opening, feedback control is additionally exercised over the throttle opening in accordance with a deviation between the actual rotation speed and target rotation speed. In this instance, the throttle opening correction amount is determined by adding a fixed value, which is determined according to mapped water temperature data, to a variable value, which is provided by feedback control. It is possible to merely exercise feedback control over the throttle opening. However, when correction is provided initially in accordance with the fixed value, the convergence of the actual rotation speed to the target rotation speed can be expedited.

If the actual rotation speed differs from the target rotation speed in a good combustion state, such a difference is attributable, for instance, to aging or manufacturing error. It is anticipated that such a difference will remain substantially the same without varying from one operation to another. Therefore, a fixed basic correction amount may be used for the throttle opening while adjusting it in accordance with the water temperature.

Control exercised when the torque variation of the internal combustion engine 2 is great will now be described with reference to FIGS. 3A through 3F. FIGS. 3A through 3F show how the estimated indicated torque, estimated indicated torque locus length, rotation speed, ignition timing, throttle opening, and fuel injection amount change in each cycle. As described with reference to FIGS. 2A through 2F, a detection sequence is performed for the first eight cycles after startup to judge the degree of estimated indicated torque variation. Torque correction control according to the present invention begins in the first cycle after the detection sequence.

If the degrees of torque variation and rotation speed variation are both great as indicated in FIGS. 3A and 3C, it can be concluded that the combustion state of the internal combustion engine 2 is bad. The bad combustion state particularly results from the use of heavy fuel. Heavy fuel is less volatile than regular fuel (light fuel). Therefore, when heavy fuel is used, the air-fuel ratio is likely became lean because an increased amount of fuel adheres to the inner wall surface of an intake port and to the surface of the intake valve. Particularly at a cold start during which the wall surface temperature is low, the air-fuel ratio becomes considerably lean because the fuel adhering to the wall surface does not readily vaporize. When heavy fuel is used, torque variation occurs due to such a lean air-fuel ratio. When the air-fuel ratio becomes lean, improper combustion or engine flameout occurs, thereby causing considerable torque variation. Further, the overall torque level decreases due to a lean air-fuel ratio so that the actual rotation speed of the internal combustion engine 2 tends to be lower than the target rotation speed.

As a way of causing the internal combustion engine 2 to generate an increased torque to raise the rotation speed, the intake air amount may be increased, as described earlier, to provide a throttle opening that is larger than the idle opening. However, torque variation resulting from the use of heavy fuel occurs because the air-fuel ratio becomes lean. Therefore, the effect produced by increasing the throttle opening is opposite to that intended. More specifically, an increase in the throttle opening decreases the negative pressure in the intake path 4 so that the fuel adhering to the wall surface does not vaporize. In the above case, therefore, an increase in the intake air amount should be avoided.

The following two solutions may be applied to the above case. One solution is to advance the ignition timing to obtain an ignition period. This solution works to avoid improper combustion and engine flameout, thereby improving the combustion state of the internal combustion engine 2 and decreasing the pressure in the intake path 4. Another solution is to increase the fuel injection amount for the purpose of enriching the air-fuel ratio. However, the fuel injection amount is usually increased during a cold start. Therefore, any further increase in the fuel injection amount might incur exhaust emission deterioration. Therefore, the present embodiment basically advances the ignition timing. However, if the torque variation is great so that the advance of the ignition timing is not adequate for the purpose, the present embodiment increases the fuel injection amount.

The ECU 30 compares the locus length obtained in the eighth cycle after internal combustion engine startup against the first judgment value. If the locus length is not smaller than the first judgment value, the ECU 30 compares the locus length against a second judgment value, which is greater than the first judgment value. The second judgment value is used to judge, in accordance with the locus length of the estimated indicated torque, whether the fuel injection amount should be increased. As regards the second judgment value, the relationship between the internal combustion engine rotation state and locus length should be determined through experiments or the like. The second judgment value should be set in accordance with the determined relationship.

If the result of comparison indicates that the locus length is smaller than the second judgment value, the ECU 30 merely advances the ignition timing for correction purposes. The amount of ignition timing advance is represented by a fixed value that is determined in accordance with the water temperature of the internal combustion engine 2. The ECU 30 determines the advance amount for correction in accordance with the water temperature detected by the water temperature sensor 34, adds the determined advance amount for correction to a basic ignition timing value, which is set in accordance with the mapped data about rotation speed and load, and sets the resulting value as a final ignition timing value. In this instance, regular control is continuously exercised over the throttle opening and fuel supply amount.

If, on the other hand, the result of comparison indicates that the locus length is not smaller than the second judgment value, the ECU 30 not only advances the ignition timing as described above, but also increases the fuel injection amount for correction purposes. The ECU 30 determines a fuel injection amount correction coefficient in accordance with the water temperature detected by the water temperature sensor 34, multiplies the startup fuel amount by the correction coefficient, and sets the resulting value as a final fuel injection amount. In this instance, regular control is continuously exercised aver the throttle opening. Solid lines in FIGS. 3A through 3F indicate changes that occur when torque correction control according to the present invention is not exercised. Broken lines indicate changes that occur when torque correction control according to the present invention is exercised (when the locus length is not smaller than the second judgment value).

When torque correction control is exercised as described above, the ignition timing advances so that the combustion state of the internal combustion engine 2 improves to provide a negative pressure in the intake path 4. Heavy fuel evaporation is then promoted so that the air-fuel ratio improves. Consequently, the overall torque generated by the internal combustion engine 2 increases and becomes stable. If the torque greatly varies so that the locus length is not smaller than the second judgment value, the fuel injection amount is also corrected by increasing it. Therefore, the air-fuel ratio is further enriched to improve the combustion state. This ensures that the torque generated by the internal combustion engine 2 is further stabilized. When the generated torque increases and becomes stable, the rotation speed of the internal combustion engine 2 increases and the degree of rotation variation decreases. As a result, the difference between the actual rotation speed and target rotation speed is eliminated to provide a stable idling operation.

If, in a situation where the locus length is smaller than the second judgment value, the actual rotation speed differs from the target rotation speed after the ignition timing is advanced for correction purposes, feedback control is exercised over the ignition timing in accordance with the deviation between the actual rotation speed and target rotation speed. In this instance, the ignition timing advance amount for correction is determined by adding a fixed value, which is determined according to water temperature, to a variable value, which is provided by feedback control. The determined ignition timing advance amount for correction is then added to the basic ignition timing value, which is set in accordance with the mapped data about rotation speed and load. It is possible to merely exercise feedback control aver ignition timing. However, when the ignition timing is initially advanced for correction purposes in accordance with the fixed value, the convergence of the actual rotation speed to the target rotation speed can be expedited.

If, in a situation where the locus length is not smaller than the second judgment value, the actual rotation speed differs from the target rotation speed after an ignition timing advance and fuel injection amount increase for correction purposes, feedback control is exercised over the fuel injection amount in accordance with the deviation between the actual rotation speed and target rotation speed. In the above instance, the fuel injection amount correction coefficient is obtained by multiplying a fixed correction coefficient, which is determined according to water temperature, by a variable correction coefficient, which is provided by feedback control. In this instance, feedback control can also be exercised over the ignition timing in accordance with a deviation between the actual rotation speed and target rotation speed.

Figure 4:
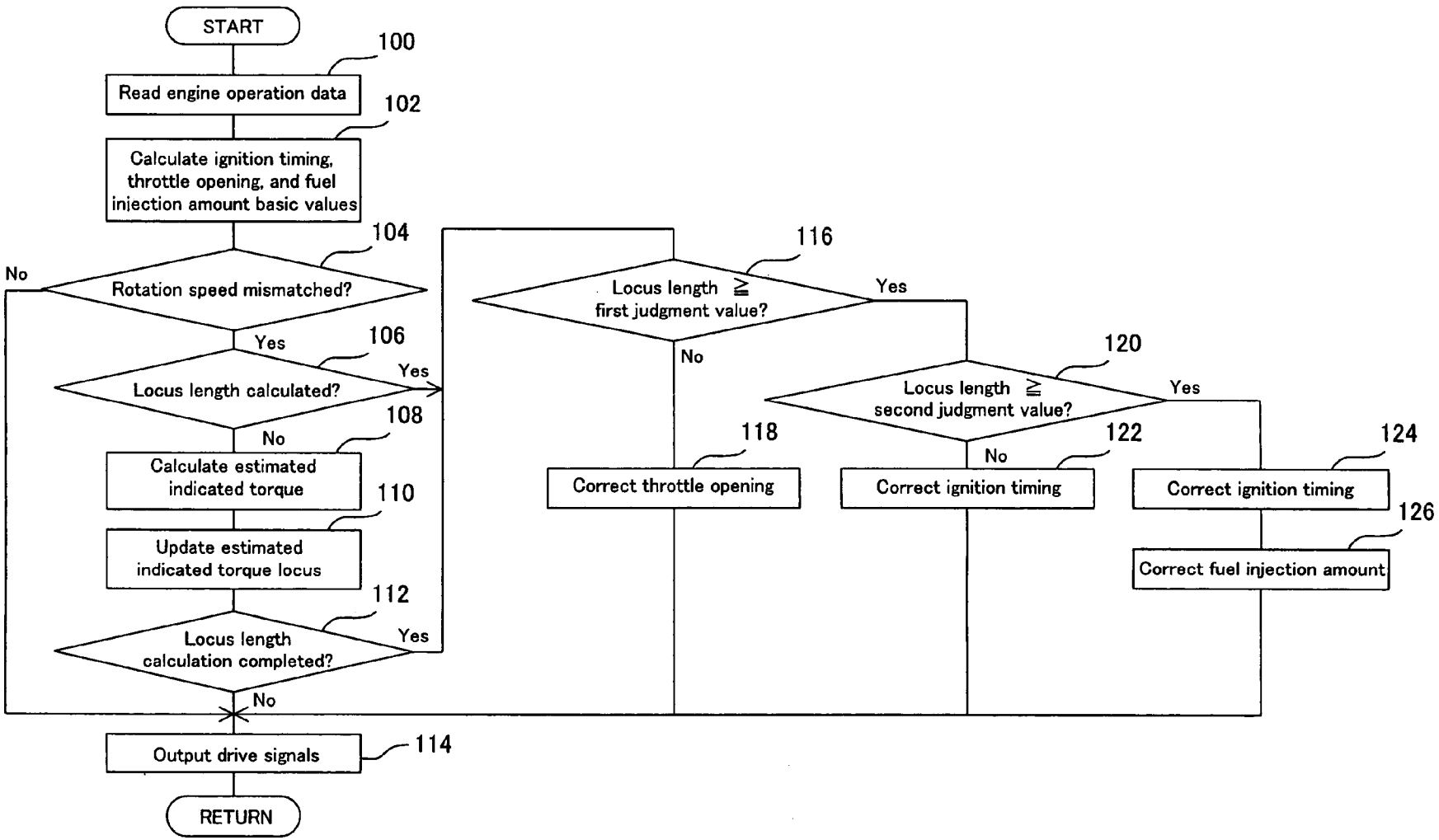
FIG. 4 is a flowchart illustrating an idling control routine that is executed by one embodiment according to the present invention.

Torque correction control, which has been described above with reference to FIGS. 2A through 2F and 3A through 3F, is exercised during idling control, which is exercised during cold fast idling of the internal combustion engine 2. FIG. 4 is a flowchart illustrating the flow of idling control that the ECU 30 exercises during cold fast idling of the internal combustion engine 2. The ECU 30 executes a routine shown in FIG. 4 on every cycle (180° CA).

In the routine shown in FIG. 4, step 100 is first performed to read operation data, which is necessary for cold fast idling period control aver the internal combustion engine 2, from the crank angle sensor 32, water temperature sensor 34, and the like. Next, step 102 is performed to set basic values for ignition timing, throttle opening, and fuel injection amount. The ignition timing is set in accordance with rotation speed and load (or rotation speed only). The throttle is set for a predefined idle opening. The fuel injection amount is set to a predetermined startup fuel amount.

Step 104 is performed to judge the difference between the actual rotation speed and target rotation speed of the internal combustion engine 2. For judgment purposes, the average value of the actual rotation speed prevailing aver a predetermined period is compared against the target rotation speed. If the obtained judgment result indicates that the difference between the actual rotation speed and target rotation speed is within a predetermined tolerance, the routine proceeds to step 114. In step 114, the basic values for the ignition timing, throttle opening, and fuel injection amount, which are set in step 102, are directly used as final settings to output drive signals to the drivers for the ignition plug 12, throttle valve 18, and fuel injection valve 14.

If the judgment result obtained in step 104 indicates that the difference between the actual rotation speed and target rotation speed is outside the tolerance, torque correction control is exercised as described above. Step 106 is first performed to judge whether the locus length of the estimated indicated torque is already calculated. As mentioned earlier, the locus length is used as an index for judging which of the torque correction control operations indicated in FIGS. 2A through 2F or 3A through 3F should be exercised. If the locus length is lady calculated, the routine performs steps 116 and beyond. If the locus length is still not calculated, the routine first performs step 108 to calculate the estimated indicated torque of the current cycle, and then performs step 110 to calculate the difference between the estimated indicated torque of the current cycle and the estimated indicated torque of the previous cycle. The calculated torque difference is then added to the estimated indicated torque locus length that is reached in the previous cycle.

The locus length of the estimated indicated torque of a predetermined number of cycles (eight cycles in a case indicated in FIGS. 2A through 2F or 3A through 3F) is determined. Step 112 is performed to judge whether the locus length calculation is completed, that is, whether the estimated indicated torque locus length of the predetermined number of cycles is obtained. If the predetermined number of cycles is still not reached so that the locus length calculation is being performed, the routine proceeds to step 114. In step 114, the basic values for the ignition timing, throttle opening, and fuel injection amount, which are set in step 102, are directly used as final settings and output to the associated drivers as drive signals.

If the locus length of the estimated indicated torque is already calculated (step 106) or the locus length calculation is completed in the current cycle (step 112), the routine performs processing steps 116 and beyond. In step 116, the calculated locus length is compared against the first judgment value to determine their relationship. If the locus length is smaller than the first judgment value, torque correction control is exercised as indicated in FIGS. 2A through 2F to calculate the correction amount for throttle opening (step 118). After completion of step 118, the routine proceeds to step 114. In this instance, step 114 is performed to use the basic values set in step 102 as the final settings for the ignition timing and fuel injection amount. As regards the throttle opening, the value obtained by adding the basic value, which is set in step 102, to the correction amount calculated in step 118 is used as the final setting. These final settings are then output to the associated drivers as drive signals If the judgment result obtained in step 116 indicates that the locus length is not smaller than the first judgment value, the locus length is compared against the second judgment value to determine their relationship (step 120). If the locus length is smaller than the second judgment value, torque correction control is exercised as indicated in FIGS. 3A through 3F to calculate the amount of ignition timing correction (step 122). After completion of step 122, the routine proceeds to step 114. In this instance, step 114 is performed to use the basic values set in step 102 as the final settings for the throttle opening and fuel injection amount. As regards the ignition timing, the value obtained by adding the basic value, which is set in step 102, to the correction amount calculated in step 122 is used as the final setting. These final settings are then output to the associated drivers as drive signals.

If the judgment result obtained in step 120 indicates that the locus length is not smaller than the second judgment value, torque correction control is exercised as indicated in FIGS. 3A through 3F to calculate the amount of ignition timing correction (step 124). Further, the correction coefficient for the fuel injection amount is also calculated (step 126). After completion of steps 124 and 126, the routine proceeds to step 114. In this instance, step 114 is performed to use the throttle opening basic value, which is set in step 102, as the final setting. As regards the ignition timing, the value obtained by adding the basic value, which is set in step 102, to the correction amount calculated in step 124 is used as the final setting. As regards the fuel injection amount, the value obtained by multiplying the basic value, which is set in step 102, by the correction coefficient calculated in step 126 is used as the final setting. These final settings are then output to the associated drivers as drive signals.

When the above routine is executed, the difference between the actual rotation speed and target rotation speed of the internal combustion engine 2, which arises during cold fast idling, is eliminated promptly and efficiently to provide a stable idling operation.

In the embodiment described above, the "rotation state judgment unit" according to the present invention is implemented when the ECU 30 performs processing step 104. The "torque correspondence value calculation unit" according to the present invention is implemented when the ECU 30 performs processing step 108. The "variation index value calculation unit" according to the present invention is implemented when the ECU 30 performs processing step 110. The "control unit" according to the present invention is implemented when the ECU 30 performs processing steps 116, 118, 120, 122, 124, and 126.

While the present invention has been described in conjunction with presently preferred embodiment of the present invention, persons of skill in the art will appreciate that variations may be made without departure from the scope and spirit of the present invention. For example, the following modifications can be made to the embodiment of the present invention.

In the embodiment described above, the estimated indicated torque is calculated continuously for all cylinders to determine the estimated indicated torque locus length of the entire internal combustion engine 2. However, an alternative is to calculate the estimated indicated torque of each cylinder, determine its locus length, and calculate the average locus length. Another alternative is to calculate the estimated indicated torque of a specific cylinder (e.g., first cylinder) only and calculate its locus length. When the internal combustion engine 2 is an inline four-cylinder engine, the estimated indicated torque is calculated at 720° CA intervals. In this instance, it is preferred that the torque variation judgment result based on the locus length be reflected in the engine control parameter setup for an explosion cylinder next to the specific cylinder (the third cylinder if the specific cylinder is the first cylinder).

FIG. 2C illustrates an example in which the actual rotation speed is lower than the target rotation speed. However, the torque correction control described above can also be applied to a case where the actual rotation speed is higher than the target rotation speed. In this instance, the basic correction amount for the throttle opening, which is set in accordance with mapped data about the deviation between the actual rotation speed and target rotation speed, is a negative value. In other words, the basic correction amount is set so as to adjust the throttle opening in the closing direction for correction purposes.

The embodiment described above uses the indicated torque, which is calculated from the crank angle signal supply from the crank angle sensor 32, as the torque correspondence value. Alternatively, however, another value may be used as far as it corresponds to cylinder-generated torque. If, for instance, a cylinder internal pressure sensor is provided for detecting the pressure within the combustion chamber 16, the indicated torque may be calculated in accordance with a signal supply from the cylinder internal pressure sensor and a signal supply from the crank angle sensor 32 and uses as the torque correspondence value. Another alternative is to determine the angular acceleration of the crankshaft 22 in accordance with a signal supply from the crank angle sensor 32 and use the angular acceleration as the torque correspondence value.

The index value for indicating the degree of torque correspondence value variation is not limited to the locus length of the torque correspondence value, which is described in conjunction with the above embodiment. For example, the ratio between the number of detection cycles in which the torque correspondence value is outside a predetermined acceptable range and the total number of detection cycles may alternatively be determined and used as the index value. Another alternative is to determine the dispersion or standard deviation of torque correspondence values in a plurality of cycles and use the determined dispersion or standard deviation as the index value.

The embodiment described above assumes that the ignition timing advance amount for correction is a fixed value corresponding to water temperature. As is the case with the basic ignition timing, however, the advance amount for correction may be set in accordance with a map that uses rotation speed and load as parameters (or a map that merely uses rotation speed as a parameter). The final advance amount for correction is obtained by multiplying the basic correction amount by a correction coefficient based on water temperature. This also holds true for the correction coefficient for the fuel injection amount. The correction coefficient for the fuel injection amount may be represented by the product of a correction coefficient determined by a map whose parameters indicate rotation speed and load (or a map whose parameter is rotation speed) and a correction coefficient based on water temperature.

The ignition timing advance amount for correction may be varied in accordance with the locus length. For example, a plurality of gradually increasing judgment values may be set above the first judgment value so that the correction coefficient for multiplying the basic correction amount be great in accordance with the locus length exceeding the higher judgment value. The final advance amount for correction is obtained by multiplying the basic correction amount by a correction coefficient based on water temperature and by a correction coefficient based on locus length. This also holds true for the correction coefficient for the fuel injection amount. The correction coefficient for the fuel injection amount may be represented by the product of the basic correction amount, the correction coefficient based on water temperature, and the correction coefficient based on locus length.

If the actual rotation speed remains different from the target rotation speed after throttle opening correction, the embodiment described above exercises feedback control over the throttle opening in accordance with the deviation between the actual rotation speed and target rotation speed. However, when the correction amount converges due to feedback control, the resulting value may alternatively be stored as a learning value. The learning value is stored in a backup RAM for the ECU 30. This also holds true for the ignition timing advance amount for correction and the correction coefficient for the fuel injection amount. The convergence value derived from feedback control may be stored as a correction coefficient learning value. The learning value may be stored in a map whose parameter represents water temperature or in a map whose parameters represent rotation speed and load (or a map whose parameter represents rotation speed only). For the next start of the internal combustion engine 2, the stored learning value is used to correct the associated engine control parameter. This ensures that once the above torque correction control is exercised, a stable idling operation can be conducted immediately after the next start of the internal combustion engine 2. Subsequent learning operations may be performed on a periodic basis or whenever refueling is performed in such a manner as to possibly change the fuel properties.

If the actual rotation speed remains different from the target rotation speed after an ignition timing advance for correction or after ignition timing and fuel injection amount corrections, the embodiment described above exercises feedback control over the ignition timing or fuel injection amount in accordance with the deviation between the actual rotation speed and target rotation speed. Alternatively, however, feedback control may be exercised over the throttle opening. When the throttle opening is changed for adjustment purposes, it is anticipated that the negative pressure in the intake path 4 might decrease. However, the difference between the actual rotation speed and target rotation speed is virtually eliminated when the ignition timing is advanced for correction purposes or when the fuel injection amount is increased for correction purposes. Therefore, a slight change in the throttle opening will suffice.

Some internal combustion engine controllers start exercising feedback control, immediately after startup, over ignition timing in accordance with the deviation between the actual rotation speed and target rotation speed. The present invention can also be applied to controllers that exercise the above control. In such an instance, the controller should exercise control according to the present invention after startup to eliminate the difference between the actual rotation speed and target rotation speed, and then start exercising ignition timing feedback control.

The internal combustion engine applicable to the present invention is not limited to the one having a configuration shown in FIG. 1. For an internal combustion engine in which an ISC valve is installed in parallel to the throttle valve, the intake air amount should be adjusted by correcting the ISC valve opening. For an internal combustion engine whose intake valve has a variable valve mechanism (e.g., solenoid-driven valve) that is capable of changing the operating angle and lift amount, the intake air amount should be adjusted by allowing the variable valve mechanism to correct the operating angle and lift amount.

The major benefits of the present invention described above are summarized follows:

If the torque correspondence value greatly varies in the plurality of previous cycles, it can be judged that the combustion state is degraded by the use of heavy fuel. If, on the other hand, the torque correspondence value varies slightly and the actual rotation speed differs from the target rotation speed, it can be judged that the intake air amount varies.

According to a first aspect of the present invention, the intake air amount for the internal combustion engine is corrected if the index value indicating the degree of torque correspondence value variation is smaller than the predetermined first judgment value. Therefore, it is possible to eliminate the difference between the actual rotation speed and target rotation speed while maintaining a good combustion state and avoiding exhaust emission deterioration. Further, if the variation index value is not smaller than the first judgment value, the ignition timing of the internal combustion engine is corrected. Therefore, the combustion state can be improved while avoiding exhaust emission deterioration. As a result, the present invention makes it possible to inhibit rotation variation and eliminate the difference between the actual rotation speed and target rotation speed.

According to a second aspect of the present invention, if the variation index value is not smaller than the predetermined second judgment value, which is greater than the first judgment value, the ignition timing of the internal combustion engine and the fuel supply amount are both corrected. Therefore, the combustion state can be improved by adjusting the air-fuel ratio. As a result, the present invention makes it possible to inhibit rotation variation and eliminate the difference between the actual rotation speed and target rotation speed.

The invention claimed is:

1. An internal combustion engine controller comprising:

a unit for judging whether the actual rotation speed of an internal combustion engine differs from a target rotation speed;

a unit for calculating a torque correspondence value corresponding to torque generated by said internal combustion engine from operation data about said internal combustion engine;

a unit for calculating a variation index value by digitizing the degree of variation of said torque correspondence value in a plurality of previous cycles;

a unit for adjusting the intake air amount of said internal combustion engine;

a unit for adjusting the ignition timing of said internal combustion engine; and a unit for controlling said internal combustion engine to eliminate the difference between said actual rotation speed and said target rotation speed;

wherein said control unit causes said intake air amount adjustment unit to correct the intake air amount of said internal combustion engine when the index value calculated by said variation index value calculation unit is smaller than a predetermined first judgment value or causes said ignition timing adjustment unit to correct the ignition timing of said internal combustion engine when said index value is not smaller than said first judgment value.

2. The internal combustion engine controller according to claim 1, further comprising:

a unit for adjusting the fuel supply amount of said internal combustion engine, wherein said control unit, when said index value is not smaller than a predetermined second judgment value, which is greater than said first judgment value, causes said ignition timing adjustment unit to correct the ignition timing of said internal combustion engine and causes said fuel supply amount adjustment unit to correct the fuel supply amount of said internal combustion engine.

3. The internal combustion engine controller according to claim 1, wherein;

said torque correspondence value calculation unit calculates said torque correspondence value of all cylinders; and said variation index value calculation unit calculates said variation index value based on the variation of said torque correspondence value of all cylinders.

4. The internal combustion engine controller according to claim 1, wherein;

said torque correspondence value calculation unit calculates said torque correspondence value of each cylinder; and said variation index value calculation unit calculates said variation index value for each cylinder based on the variation of said torque correspondence value of each cylinder.

5. The internal combustion engine controller according to claim 1, wherein;

said torque correspondence value calculation unit calculates said torque correspondence value of a specific cylinder; and said variation index value calculation unit calculates said variation index value based on the variation of said torque correspondence value of said specific cylinder.

6. The internal combustion engine controller according to claim 1, wherein said torque correspondence value calculation unit uses indicated torque calculated from crank angle as said torque correspondence value.

7. The internal combustion engine controller according to claim 1, wherein said torque correspondence value calculation unit uses the angular acceleration of a crank as said torque correspondence value.

8. The internal combustion engine controller according to claim 1, wherein said variation index value calculation unit calculates the locus length of said torque correspondence value in a plurality of previous cycles and uses said locus length as said variation index value.

9. The internal combustion engine controller according to claim 1, wherein said variation index value calculation unit calculates the ratio of the number of cycles in which said torque correspondence value is outside a predetermined acceptable range to the total number of cycles in which said torque correspondence value is calculated and uses said ratio as said variation index value.

10. The internal combustion engine controller according to claim 1, wherein said variation index value calculation unit calculates the dispersion or standard deviation of said torque correspondence value in a plurality of previous cycles and uses said dispersion or standard deviation as said variation index value.

* * * * *